US007114670B2

(12) United States Patent
Robidoux

(10) Patent No.: US 7,114,670 B2
(45) Date of Patent: Oct. 3, 2006

(54) SELF-CONTAINED POWDER COATING SYSTEM

(75) Inventor: Mark A. Robidoux, Coatesville, PA (US)

(73) Assignee: Wetherill Associates, Inc., Royersford, PA (US)

( * ) Notice: Subject to any disclaimer, the term of this patent is extended or adjusted under 35 U.S.C. 154(b) by 175 days.

(21) Appl. No.: 10/981,977

(22) Filed: Nov. 5, 2004

(65) Prior Publication Data

US 2006/0097071 A1 May 11, 2006

(51) Int. Cl.

| | |
|---|---|
| ***B05B 5/00*** | (2006.01) |
| ***B05B 12/10*** | (2006.01) |
| ***F23D 11/32*** | (2006.01) |
| ***B05C 11/00*** | (2006.01) |
| *B05B 7/02* | (2006.01) |
| *B05B 9/01* | (2006.01) |

(52) U.S. Cl. ..... 239/699; 239/700; 239/704; 239/705; 239/706; 239/708; 239/690; 239/525; 239/310; 239/318; 239/79; 239/85; 118/308

(58) Field of Classification Search ..... 239/690, 239/690.1, 700, 706, 708, 525, 310, 318, 239/378, 372, 373, 311, 570, 79, 85, 654; 118/304

See application file for complete search history.

(56) References Cited

U.S. PATENT DOCUMENTS

| | | | | |
|---|---|---|---|---|
| 5,850,976 | A | 12/1998 | Robidoux | |
| 5,997,643 | A * | 12/1999 | Wilson et al. | 118/308 |
| 6,003,779 | A | 12/1999 | Robidoux | |
| 6,467,705 | B1 | 10/2002 | Robidoux | |
| 6,883,732 | B1 * | 4/2005 | Hasegawa | 239/416.5 |
| 2004/0050963 | A1 * | 3/2004 | Ray et al. | 239/321 |
| 2004/0159724 | A1 * | 8/2004 | van der Steur | 239/690 |
| 2004/0195404 | A1 * | 10/2004 | Lunzer | 239/690 |

* cited by examiner

*Primary Examiner*—David A. Scherbel
*Assistant Examiner*—James S. Hogan
(74) *Attorney, Agent, or Firm*—Robert B. Famiglio, Esq.; Famiglio & Associates

(57) ABSTRACT

A powder coating gun with an internal fan and a quick-change powder cartridge. Pressurized air generated by the fan entrains the powder coating material from the powder cartridge and the entrained powder coating material is charged in the ionizing field created by an emitter. The replaceable cartridge contains an inlet line and an outlet line oriented in a manner that allows the powder gun to be positioned in different angles and orientations with minimal risk of a powder spill from the powder coating gun. The powder cartridge contains a lid for supporting an inlet line and a body part constructed of clear or translucent material that allows the user to easily view the color of the powder. An electric power supply is used to power the fan and the emitter. A trigger is present in the handle of the powder coating gun and both controls the speed of the fan and enables the charge to the emitter.

12 Claims, 5 Drawing Sheets

SELF-CONTAINED POWDER COATING SYSTEM

FIELD OF THE INVENTION

The disclosed invention generally relates to powder coating systems, and specifically to a powder coating gun with a quick change powder cartridge and an internal air source to yield a self-contained powder coating system.

BACKGROUND OF THE INVENTION

Powder coatings utilize pulverized polyester, epoxy or polyurethane plastics, extruded and ground to specific particle size ranges depending on the painting application. The powders are preferably thermoset or thermoplastic polymers with additives and pigments. Powder materials have the consistency of talc or flour and pose no environmental hazards, and pose the same health risks as any air born dust.

Powder coating guns are used to apply protective coatings on industrial and commercial products. In summary, the powder coating process is as follows. A powder gun is provided with a step-up transformer to supply high voltage power to an emitter located in the outlet nozzle of the powder coating gun. Present powder coating guns are also provided with a source of compressed air that flows through a container containing the powder coating. The container is usually an external jar or appendage to the guns. The source of compressed air for present powder coating guns is an external air compressor or compressed air source such as a tank which is attached to the gun through an air hose. The air hose most often used to provide existing guns with compressed air is the type used to supply compressed air to a variety of air powered tools and connect to a typical gun with commonly used air hose fittings and connectors.

The compressed air introduced into powder coating guns entrains the powder coating, the coating then being fluidized, and is passed parallel to an emitter which imparts an electrical charge to the powder coating material. The charged coating powder is thereafter sprayed in the direction of the grounded work piece to be coated. The work to be sprayed being at ground potential, from an electrical charge perspective, the charged coating powder is attracted to and deposits uniformly on the surface of the grounded work piece.

After the work piece has been coated with the powder coating, the work piece is cured in an oven at approximately 400° F. for 10 minutes. The deposited powder melts and flows together to bond and form a more permanently adhered coating on the work piece as it cools.

Conventional solvent based paint technology has several disadvantages. Spills from paint containing inorganic solvents pose a threat to the environment. Millions of aerosol paint cans are sold each year and contribute to environmental destruction and land fill concerns. The propellants and volatile organic compounds given off by aerosol paints are very toxic to both the user and bystanders. The over spray is also a concern when aerosol paints are used.

Powder coating technology has a number of advantages over conventional solvent-based paint technology. Powder coating is an environment friendly solution as the level of accidental spills are reduced, and the content of the spill is a particulate dust that can be easily collected and disposed. Also, powder coating technology enables the application of a uniformly thick coating and automated operation. Powder coatings also show excellent chemical resistance to gasoline, oil, methyl ethyl ketone, acetone and household cleaners.

Powder coatings are also more flexible than conventional solvent based paints. Powder coatings are also ultra violet resistant, and maintain high gloss and luster for years in outdoor exposure.

Powder coatings are used to coat a variety of products such as automotive components, metal office furniture and storage shelving, electrical transformers, and recreational equipment. Present powder coating systems are not well adapted for use by the casual users, hobbyist, or any application in which the user does not have an air compressor and a dedicated paint preparation area to facilitate cleaning the paint gun throughly each time a color change is desired with the same powder coating gun.

The primary components of a powder coating system is the powder coating gun, supply and control of the air required to entrain the powder coating materials, and a supply of high voltage power to an electrode referred in the trade and in this application hereafter as an emitter. High voltage is required to charge the emitter located in or near the discharge nozzle of the powder coating gun to produce a corona effect that imparts an electrostatic charge to the powder coating particles that pass through the ionizing field at the tip of the emitter, and which are subsequently directed towards the work piece to be painted. As the entrained powder coating material passes through this ionizing field of the air space at tip of the emitter, the powder particles are charged and drawn to the grounded work piece to be painted.

Currently, powder coating work is undertaken primarily by manufacturers and custom coaters. The equipment used to apply the powder coating ranges in price from $1,000 to $25,000 and ovens used for curing are typically large in size. Manufactures hang the products to be coated from large overhead conveyors and apply powder either manually or with robotic "gun movers". Once the powder is applied to the product, the product is placed in large gas or electric ovens that cure the powder at about 400° F. for approximately 10 minutes at peak metal temperature. The curing process is very important. Curing temperatures or an oven residence time below the optimum will result in under-cured powder, which may chip easily when the product is put in service.

As described above, conventional powder coating systems use an air compressor located external to the body of the powder coating gun to supply pressurized air to entrain or fluidize the powder coating material. The flow rate of the compressed air is controlled by regulators in a control panel external to the powder coating gun itself. The flow rate of the air is proportional to the rate of utilization of the powder coating material. When a fine powder coating is used, an over-supply of compressed air reduces the coating powder usage efficiency.

In conventional powder coating gun systems, the powder coating flow path within the powder coating gun generally requires cleaning when the powder coating or the powder color is changed. This coating powder build-up is more significant at the outlet section of the coating powder flow path including the discharge nozzle of the powder coating gun and powder feed hose or line. In general, the nozzle and feed hose need to be cleaned when ever the powder color is changed. Cleaning the gun is a time consuming process for the operator.

Industrial guns charge the particles at voltages of approximately 80,000 volts. Use of such high voltages is a safety risk in non-commercial and household applications. Industrial guns and other present art systems require a source of compressed air externally to provide the air flow necessary to operate such tools. The home craftsman, hobbyist or small shop owner is not well served by the features or requirements of the present art in powder coating systems for such reasons. A self contained tool which eliminates the need for an air compressor and elaborate shop facilities for cleaning the gun between uses is needed.

Accordingly, there is an unsatisfied need for a powder coating gun that allows a quick-change of paint cartridges, obviates the need for an external air compressor, and runs at a lower and safer voltage to enable use of the powder coating powder gun system in non-commercial and home applications.

SUMMARY OF THE INVENTION

The present invention provides a powder coating gun for spraying electrostatically charged powder onto a work piece to form a coating, a quick-change powder coating cartridge as a source of the powder, an internal self-contained variable speed fan to provide an air source, an emitter to charge the powder as it is expelled from the gun, and a trigger mechanism integrated into the gun which both controls the application of power to the gun and the internal fan speed over a predetermined range to control the rate of delivery of powder by increase or decreased pressure on the trigger. The preferred embodiment provides a self contained coating system withing a single housing which requires only an external conventional power source such as typical 120 volt alternating current and a simple external grounding wire connection from the power source ground to the work piece.

The present invention discloses a quick-change and replaceable powder coating cartridge to replace the conventional powder source or powder container in the powder coating gun. The quick-change cartridge allows the powder coating in the powder coating gun to be changed quickly when powder coatings or powder colors are changed, without the inconvenience of cleaning the flow path of the entrained powder in the powder coating gun. With the present invention, the process of changing the powder coating or powder color involves removing the quick-change powder cartridge, wiping the emitter and installing the new powder cartridge.

The preferred embodiment disclosed also provides an internal air source in the form of a self-contained fan disposed within the housing of the powder coating gun. The self-contained fan obviates the need for an external air compressor and also increases the usage efficiency of fine powder particles.

The fan is controlled by a variable speed drive motor, the speed of which is controlled by a trigger located in the handle of the gun. This built-in fan speed control allows control of the optimum air flow and powder delivery to the work piece to be coated, while simultaneously controlling power to the emitter. The powder coating system disclosed is also engineered to charge the powder particles at a much lower, safer voltage of 18,000 volts direct current at about 15 microamperes. It has been determined that this voltage range is sufficient to provide good results without presenting electrical hazards to the user.

Accordingly, it is the object of the present invention to provide a self-contained powder coating system which includes an internal air source, an internal source of powder coating materials, and a power supply to provide high voltage for transferring a charge to the powder coating material being sprayed onto an object.

It is another object of the present invention to provide a self-contained powder coating system which contains an internal air pressure source which is user controllable to vary the air flow rate on a continuous basis during the application of powder coating material with the system.

It is a further object of the present invention to provide a self-contained powder coating system which provides an internal, self contained source of powder coating material which can be quickly changed by the user with only minimal cleaning or conditioning of the system between the application of another powder coating material or color.

It is yet a further object of the present invention to provide a self-contained powder coating system in the form of a paint spray gun which includes a variable speed fan to entrain or fluidize powder coating material, an internal source of powder coating material contained within a interchangeable cartridge system which communicates with the output of the fan and the output nozzle of the system as a source of fluidized powder coating material, a power supply to provide high voltage for transferring a charge to the powder coating material being sprayed onto an object as the material passes through the output of the system, and an integrated control mechanism within the handle or grip of the gun to provide activation of the power to the system and to continuously vary the rate of the output of the powder coating material as the user may require while the system is in the process of applying the material.

DETAILED DESCRIPTION OF THE INVENTION

The present invention provides a powder coating system comprising a powder coating gun for spraying the powder on to a work piece, a quick-change powder cartridge, an internal fan, and a device for simultaneously controlling power to the emitter and controlling the flow of the pressurized air from the fan and the powder that it subsequently entrains or fluidizes from the quick-change powder coating cartridge.

Figure 1:
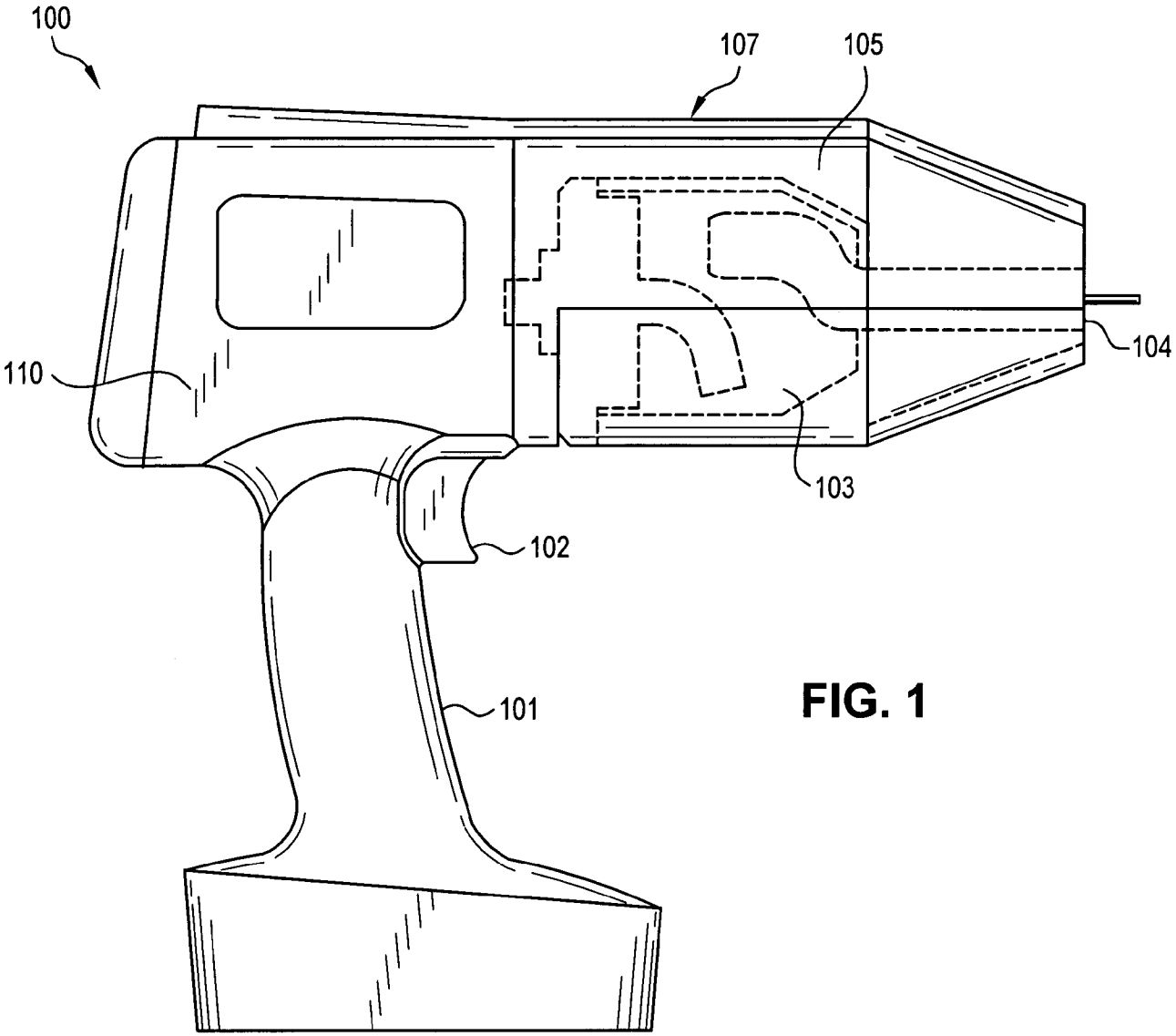
FIG. 1 is the perspective view of the powder coating gun in accordance with the present invention.

FIG. 1 illustrates the powder coating gun system 100 in a preferred embodiment configured in the form of a gun, much as a handheld power drill, impact driver, or conventional paint sprayer form factor. The powder coating gun system 100 consists of gun 110, a quick change powder cartridge 103, and an internal source of pressurized air such as an internal fan 106 or an internal air compressor, a gun handle 101, trigger switch 102, main housing 107, gun nozzle 104, and cartridge receiver assembly 105.

Figure 2:
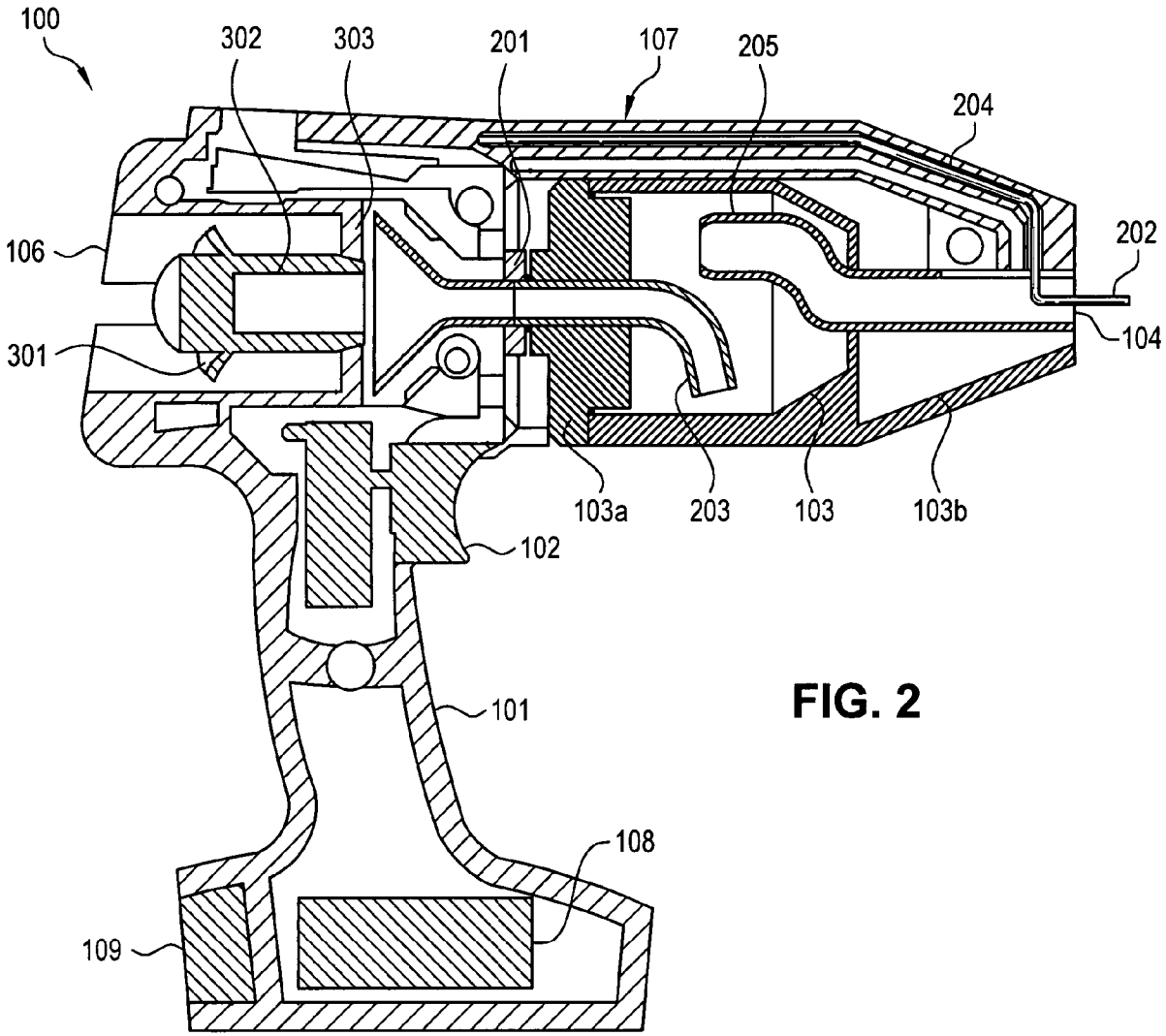
FIG. 2 is a cross-sectional view of the powder coating gun shown in FIG. 1.

FIG. 2 illustrates the cross-section of paint gun system 100, providing an internal view of cartridge receiver assembly 105 consisting of a quick-change powder cartridge 103, an internal fan 106, an emitter assembly 202, a transfer tubes 203 and 205 for introducing air into and transferring the powder out of the cartridge, and a nozzle 104 from which the electrostatically charged coating powder particles are discharged onto the grounded work piece. The emitter assembly 202 consists of a housing for conductive rod 204 which is a continuous piece of conductive metal or wire which terminates in the threshold of or slightly protrudes from nozzle 104 as shown. More particularly the housing for rod 204 is sized and shaped to be received within a smaller diameter section of the central flow path within the powder coating gun such as to assure that the powder material being expelled from nozzle 104 during operation of the gun is uniformly exposed to the tip of the emitter assembly 202 such as to impart a high voltage charge to the fluidized powder material as it is carried out of nozzle 104. A central bore is defined through the housing as suggested in FIG. 2 and is sized and shaped to allow maximum airflow through the central flow path from the high pressure side of the internal air source, such as fan 106, through the removable cartridge 103 to the nozzle 104. A path through the sleeve is provided to accept a portion of conductive rod 204. The conductive rod 204 is typically formed using stainless steel or a similar material. The power cable connector 109 is internally connected to a power supply 108 capable of supplying a predetermined DC voltage to be supplied to the emitter assembly 202. Although it is possible to use a range of different voltage levels in the powder coating process, the range of 16 kilovolts (KV) to 18 KV is used in the preferred embodiment as a suitable voltage with good results, providing a favorable compromise between performance, safety and convenience. The power connector 109 accepts low voltage power supplied from a typical wall plug transformer which converts 120 volt AC to a 10 volt to 12 volt AC supply to drive power supply 108.

Referring to FIG. 1 and FIG. 2, cartridge assembly 103 comprises an inlet line 203, an outlet line 205, and a nozzle 104. Nozzle 104 has an open end to output charged powder toward the item or work piece to be coated. Cartridge receiver assembly 105 is formed using an electrically insulating material, for example, acrylonitrile butadiene styrene (ABS), Polyethlene, or the like.

Figure 3:
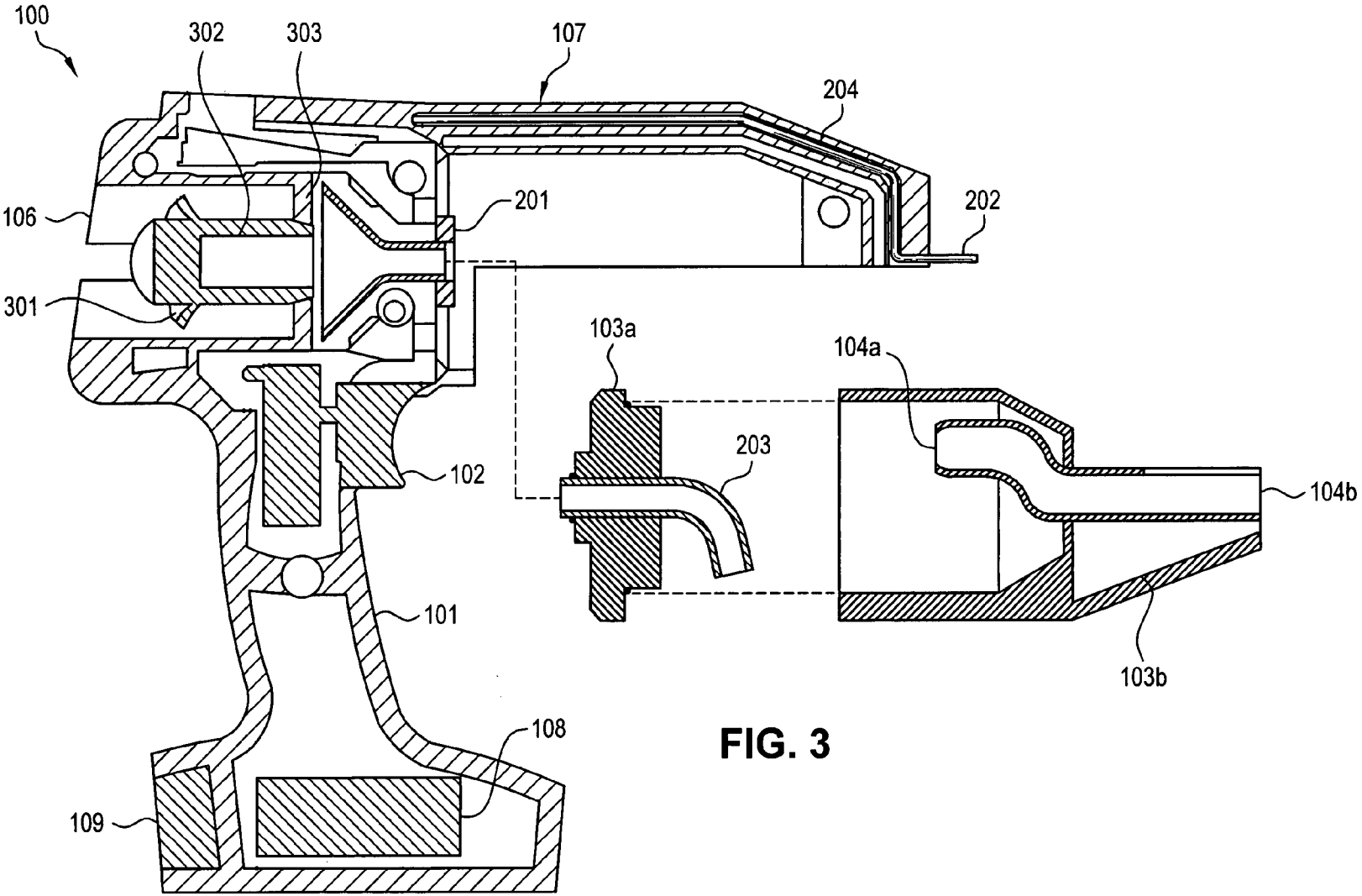
FIG. 3 is the cross-sectional view of the powder coating gun further illustrating the removable powder coating cartridge in an exploded view.

FIG. 3 illustrates a cross-section of the quick-change powder coating cartridge 103 showing the cartridge cap 103*a* removed from the cartridge body as it would be to fill cartridge 103. It is also possible to fill cartridge 103 by inserting a fill nozzle into the cartridge intake tube 203 where tube 203 exits the cap 103*a*. A nozzle powder filling device allows powder to fill into cartridge 103 conveniently and without splatter or spill. The material of the quick-change powder cartridge 103 is comprised of an ABS, acrylic or other clear composite or translucent plastic material that is of a rigid nature. The powder cartridge 103 has a unique inlet line 203 for transport and flow of the incoming pressurized air from the fan 106, an outlet line 205 which includes an input nozzle 104*a* which communicates with outlet 104*b* for ionization of entrained powder to take place at the emitter 202. Inlet line 203 and outlet line 205 are positioned and oriented in the powder cartridge to minimize powder spills from powder coating gun 110 if the powder coating gun system 100 is accidentally positioned in different angles and orientations, such as sideways or up side down.

The powder cartridge 103 is comprised of two parts, cartridge cap 103*a* and body part 103*b*. Cartridge cap 103*a* is designed large enough to allow a powder fill machine nozzle to be inserted into the powder cartridge 103, and also to support the inlet line 203. Body part 103*b* is of a clear or translucent material that allows the user to see the color of the powder. Once the quick-change powder cartridge 103 is filled with the powder coating and inserted into the powder coating gun 110, body part 103*b* and cartridge cap 103*a* are joined via a friction fit using an o-ring seal means, with positive lock molded detent on lid part 103*a* and female slots molded into the cartridge body part 103*b*. The internal fan 106 and the quick-change powder cartridge 103 are assembled using slide inserts collar 201. The output of fan 106 is in fluid communications with cartridge inlet line 203 to assure that the pressurized air which comprises the output of fan 106 is introduced into the material reservoir holding the powder coating material within cartridge 103. The path of the output of the pressurized air source, such as fan 106, is continuous from the source of the air into and through the powder coating material cartridge, then exiting the cartridge with entrained material flowing to the output nozzle where the material receives the high voltage charge which urges the material into the folds, crevices and irregular surfaces of the work piece being coated.

Figure 3A:
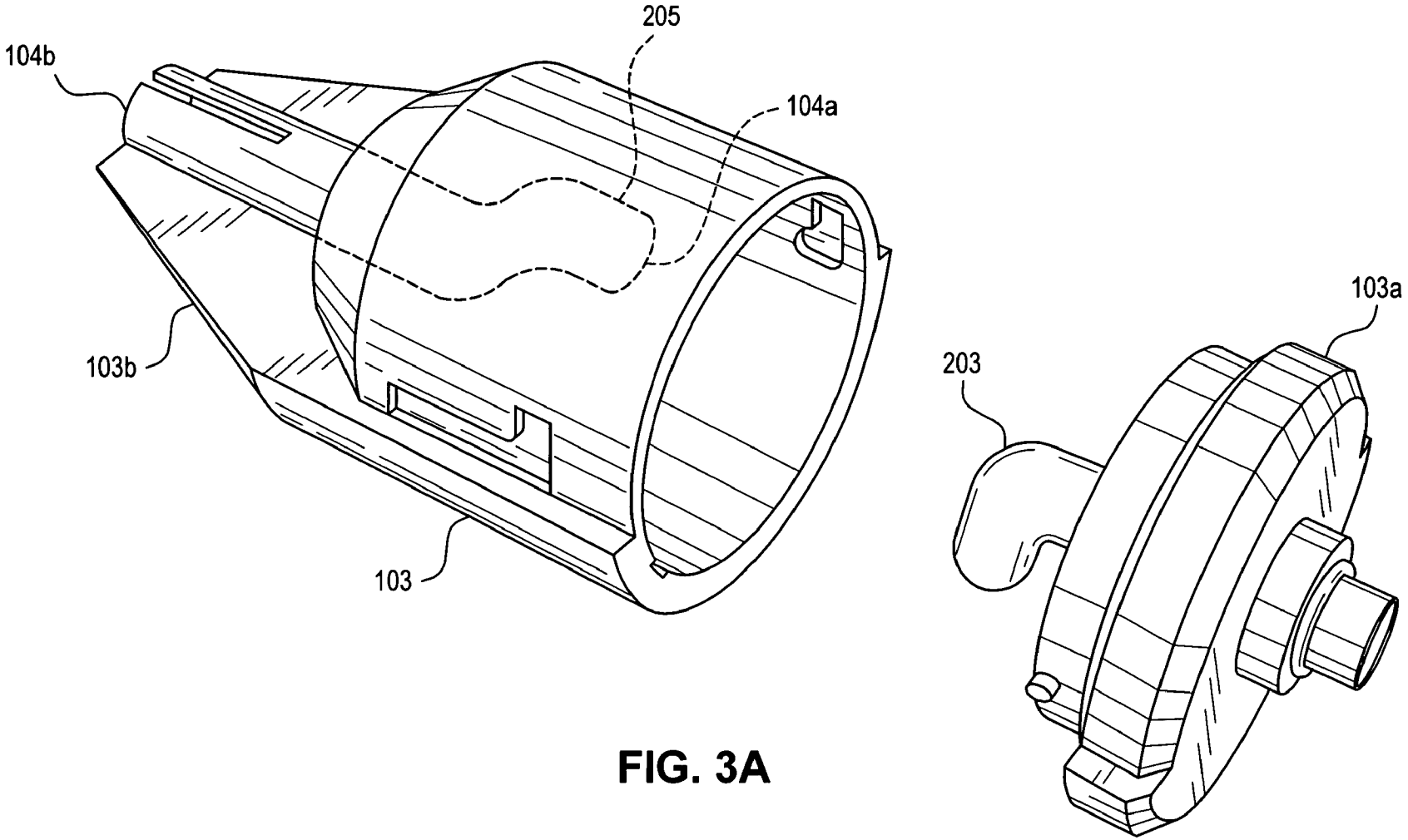
FIG. 3*a* is a perspective view of the powder coating cartridge used in the invention.

FIG. 3*a* is a perspective view of the powder cartridge 103 showing more detail. As can be seen in the exploded view in FIG. 3*a*, lid part 103*a* is molded such as to provide detents which match the cartridge body part 103*b*, so that it may be fastened shut through the locking of the molded detents in the cartridge body as shown in the figure. Other means of fastening lid part 103*a* to body part 103*b* may be accomplished through mating thread design or other clamping means such as to provide for a firm attachment after the filling process of cartridge 103.

FIG. 3*a* also illustrate the slot fashioned in cartridge body part 103*b* at the nozzle shown at 104*b* so that emitter 202 may transition into 205 such as to present emitter 202 through approximately the center of nozzle 104 as shown generally in FIG. 2.

Figure 4:
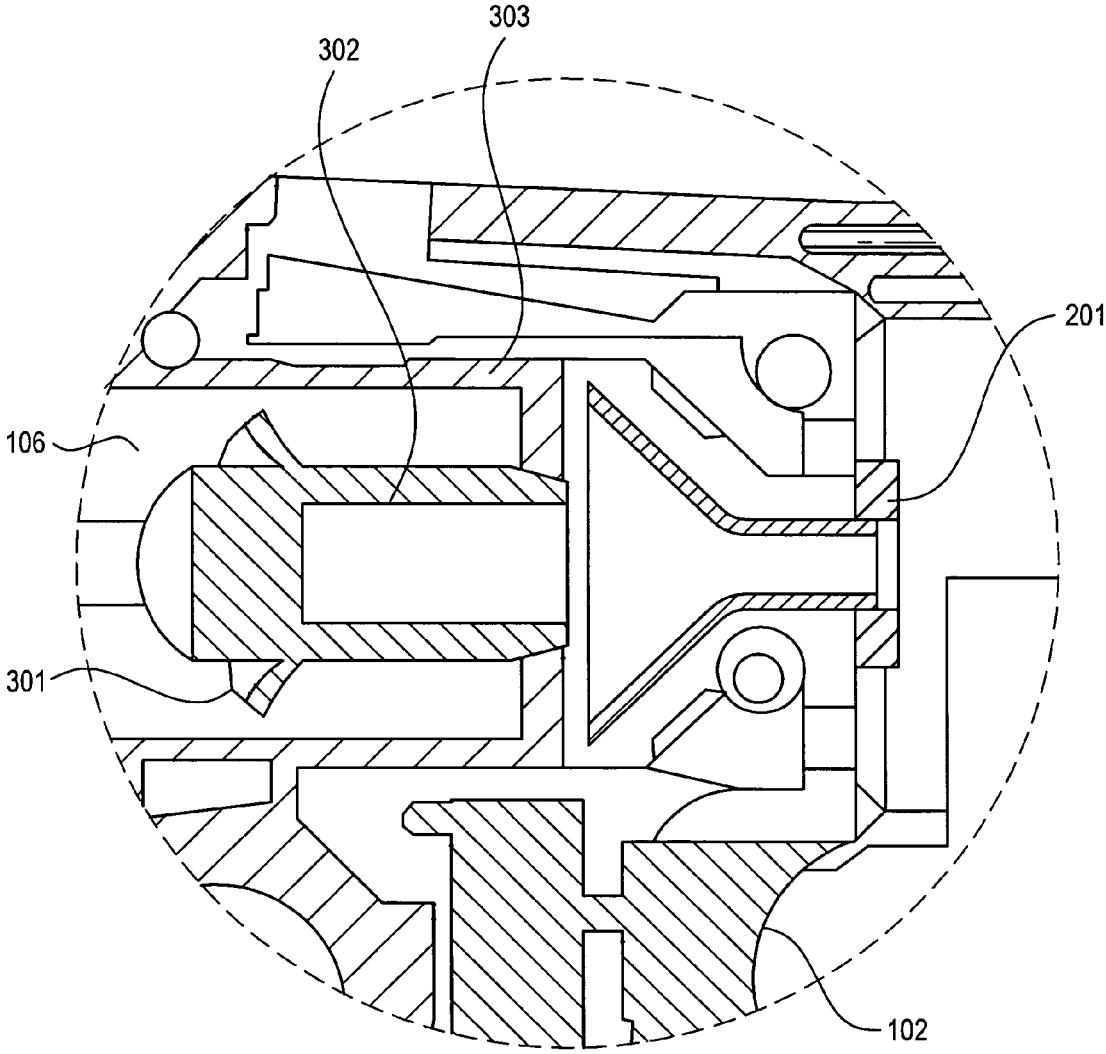
FIG. 4 is a cross-sectional view of the internal self-contained fan and the interface between the fan output and airflow collection into the powder coating cartridge.

FIG. 4 shows an internal fan 106 self-contained within the powder coating gun system 100. The speed of the internal fan 106 is controlled by a variable speed direct current motor 302 with a 0 rpm to approximately 15,000 rpm range. In the preferred embodiment of the invention, a 24 volt motor is used with good results, though it can be appreciated by those skilled in the art that different variable speed motors can be used in the present application to provide a continuously variable flow rate. Motor 302 is mounted on the motor housing 303. The speed of the motor and therefore the fan 106 speed is controlled by the trigger switch 102 located in the handle of the powder coating gun. It can be appreciated by those skilled in the art that fan 106 can be fashioned to operate from variable voltage or variable current control system as many different systems for speed control of the fan would yield the desired result.

The air flow speed effects the paint powder delivery rate, and the control system for the fan creating the air flow may vary as the application requires. Air is drawn from the rear of the gun 110 housing through the acrylonitrile butadiene styrene (ABS) or polyphenylene sulphide (PPS) molded fan blades 301 at a rate of approximately 0.5 to approximately 0.75 cubic feet per minute. It should be appreciated that the self contained air source represented in the preferred embodiment as fan 106 may be replaced with an alternate source of air to fluidize the powder coating material. A small air compressor system or a pre-charged canister of compressed gas may be used to substitute for fan 106. One of the objectives in system 100 is to provide a self contained unit which does not require substantial external apparatus to produce pressurized air to create flow through the power coating material supply to entrain the material and drive it through the nozzle system where it receives a voltage charge. A replaceable or fixed air charging container replacement for fan 106 would allow system 100 to remain self-contained. However, such alternative air or gas sources would require replacement or recharging. The use of such an alternative source of pressurized air would have the advantage of reducing the power requirements of fan 106, thereby allowing system 100 to be powered by a more portable battery supply system if desired.

The rigid blades 301 of the fan and the close tolerance of the internal housings 303, once mated, create the pressurized air flow and air flow path required to entrain the powder coating material from the powder coating cartridge 103. The pressurized air from internal fan 106 flows into and along the air flow path 203 through the replaceable powder cartridge 103 where the pressurized air suspends the powder coating particles and carries them through the ionized air space at the emitter 202 tip and discharges the charged coating powder through discharge nozzle 104*b* to the work piece to be coated. As can be seen from FIG. 2, the transfer tube 203 accepts airflow from a funnel-like device which collects the output of fan 106 and directs it through collar 201 into cartridge 103 as illustrated in more detail in FIG. 4.

FIG. 2 illustrates the completed airflow path used in the operation of the powder-coating system 100. The powder coating system 100 uses a 120 volt alternating current (VAC) grounded transformer to step-down the incoming 120 VAC to 24 volt direct current (VDC) at 1 ampere via a 12 foot to 16 foot interconnect power cable connector 109 to the base of gun 110. The 24 VDC, 1 ampere current is then routed to the variable speed trigger switch 102, (using conventional low voltage wiring suitable for the application), which applies the 24 VDC to the high voltage power supply and 24 VDC, 0.5 amperes to the fan motor 302. The high voltage power supply step-up transformer 108 converts the 24 VDC to 18,000 VDC, at a current output of 15 microamperes for charging emitter 202. The high voltage is conducted to the emitter tip at nozzle 104 by a direct crimp and solder connection of the conductive rod 204 at the transformer output terminal.

In FIG. 2, rod 204 is illustrated as traveling through the main housing 107, but then is connected to power supply 108 by being positioned through the housing of gun 110 (not shown), through main housing 107, communicating to power supply 108 through gun handle 101 attaching ultimately to power supply 108. Conductive rod 204 is located within gun 110 such as to prevent arcing to other metallic components. As can be appreciated by one skilled in the art, rod 204 travels through the mechanism such as to stay clear of such components which may be conductive or otherwise cause a loss of electrostatic charge as the charge is communicated from supply 108 to emitter 202 through rod 204. The connection is insulated by silicone shrink wrap to prevent current leakage or arcing to nearby components.

When the trigger switch 102 is actuated, input voltage is applied from the switch to the high voltage power supply 108 and the internal fan 106 creates a flow of pressurized air into the inlet tube 203. The airflow entrains the powder from the powder cartridge 103 into the outlet line 205. The powder coating particles travel through the outlet line 205 and through the downstream ionizing field generated by emitter 202, and are discharged through nozzle 104*b* to the work piece to be coated. The emitter assembly 202 comprises an electrode 204 of approximately 0.093 inches diameter, fabricated from type 304 or 316 stainless steel.

The high voltage applied to the emitter 202 travels the length of the emitter and ionizes the air at the tip of the emitter 202 by the corona effect, which in turn charges the charges the powder coating particles that flow past this ionic field. The charged particles discharged through the nozzle 104 are attracted to and deposit on the grounded work piece to be coated. The work piece is grounded using a ground clip. The grounding clip typically is run from the housing of the 120 volt transformer to the work piece to place the piece at ground potential or a neutral potential as referenced against the charge potential placed on the charged powder coating particles leaving the nozzle under operation of the gun. The transformer used in the present invention typically is of the design configured to reside on a typical AC wall outlet, thereby providing the lower 24 volt AC which is introduced into system 100 through a connecting power cord.

Although it is possible to run a ground return connection from the gun 110 to the work piece, it is more convenient to utilize the AC power ground available at the wall mounted transformer by running a wire from the ground port in the AC plug directly over to the work piece using a conventional alligator clip or similar temporary connector. The ground return path contains very low current and any suitable conductor, even of a smaller gauge wire, may be used satisfactorily. While the powder coating system 100 will actually operate without the ground return wire attached to the work piece, much more satisfactory results are obtained by assuring that the ground return path is connected to the piece. A good ground return path maintains the greatest potential differential between the charged particles which comprise the fluidized powder coating material and the work piece, therefore assuring the greatest and most uniform attraction of the material to all surfaces of the work piece. The charged powder coating particles actually wrap around the work piece and uniformly coat the work piece.

With the above, a complete, self-contained, powder containing system has been disclosed in full detail. It may be apparent to those skilled in the art upon review of this disclosure that other embodiments may be configured which may function in a similar fashion to the embodiment presently disclosed.

The invention, including the preferred embodiments disclosed above, is not limited to the precise constructions disclosed in the specification, or shown in the drawings as examples. The invention also encompasses such modifications and equivalents that are met by the appended claims.

The invention claimed is:

1. A powder coating gun, comprising:

a fan self-contained within the powder coating gun;

an emitter assembly for charging the powder coating, said emitter assembly housed within said powder coating gun;

a power supply connected to power the fan and the emitter assembly;

a cartridge to hold powder coating material in fluid communication with the fan and detachably housed in the powder coating gun, and a trigger at the base of said powder coating gun for controlling the speed of the fan and for activating or deactivating the charge to the emitter.

2. A powder coating system configured within a handheld housing, comprising:

a pneumatic generator to provide air flow to fluidize powder coating material;

an emitter assembly for charging fluidized powder coating material as said material exits the system;

a power supply used to power said pneumatic generator and the emitter assembly;

a cartridge containing powder coating material, said cartridge in fluid communication with said pneumatic generator; and a control device for controlling the output of said pneumatic generator and for activating or deactivating the charge to the emitter.

3. The powder coating gun of claim 1, wherein the said cartridge is removable.

4. The powder coating gun of claim 2, wherein the said cartridge is removable.

5. The powder coating gun of claim 1, wherein said cartridge comprises:

a lid section to allow powder coating material to be placed into the cartridge;

a body constructed of clear or translucent material that allows the user to view the interior of the cartridge, said body and lid joined via a friction fit with positive lock molded detent on the lid part and female slots molded into the body.

6. The powder coating gun of claim 2, wherein said cartridge comprises:

a lid section to allow powder coating material to be placed into the cartridge;

a body constructed of clear or translucent material that allows the user to view the interior of the cartridge, said body and lid joined via a friction fit with positive lock molded detent on the lid part and female slots molded into the body.

7. The powder coating gun of claim 1, wherein the trigger switch controls the speed of the fan.

8. The powder coating gun of claim 2, wherein the trigger switch controls the output of the said pneumatic source.

9. The powder coating gun of claim 1, wherein the power supply is located within the powder coating gun.

10. The powder coating gun of claim 2, wherein the power supply is located within the powder coating system.

11. A system for spraying a powder onto a work piece to form a coating, said system comprising:

a housing which encloses a source of pressurized fluid;

a source of electrical potential including a power supply with a variable control wherein said control is operatively interconnected to said source of pressurized fluid to modulate the output of said source of pressurized fluid;

a powder container within said housing disposed in fluid communication with said source of pressurized fluid wherein powder coating material within said container is fluidized by fluid flow from said source of pressurized air when said source of pressurized fluid is activated; and, a nozzle having a passageway including an open end in fluid communication with said powder container, said nozzle imparting an electrical charge to when fluidized powder travels through the nozzle.

12. A gun for spraying a powder onto a work piece to form a coating, said gun comprising:

a pistol-grip housing including a trigger actuated source of pressurized fluid and supporting a power supply that is operatively interconnected between said source of pressurized fluid and the trigger wherein said trigger controls the pressurized fluid;

a powder container disposed in fluid communication with said trigger actuated source of pressurized fluid wherein said powder is fluidized by fluid from said source of pressurized fluid when said trigger is actuated;

a nozzle having a first end through which said fluidized powder from said powder container is introduced into a passageway through which said fluidized powder emerges at a second end; and, an emitter assembly positioned in proximity to said second end of said nozzle for electrically charging said powder, wherein said power supply is positioned within said housing for providing a charge to said emitter assembly.

* * * * *